US005687605A

United States Patent [19]

Main

[11] Patent Number: 5,687,605

[45] Date of Patent: Nov. 18, 1997

[54] WIPING UNIT FOR RAM OF BODYMAKER

[75] Inventor: Ralph Main, San Pedro, Calif.

[73] Assignee: Sequa Corporation, Hackensack, N.J.

[21] Appl. No.: 674,288

[22] Filed: Jul. 2, 1996

Related U.S. Application Data

[63] Continuation of Ser. No. 295,232, Aug. 23, 1994, abandoned.

[51] Int. Cl.[6] ..... B21D 22/00; B21D 22/21

[52] U.S. Cl. ..... 72/347; 277/24

[58] Field of Search ..... 72/43, 347

[56] References Cited

U.S. PATENT DOCUMENTS

| | | | |
|---|---|---|---|
| 2,776,173 | 1/1957 | Rudy | 277/24 |
| 3,720,418 | 3/1973 | Berg | 277/24 |
| 3,735,629 | 5/1973 | Paramonoff | 72/349 |
| 3,825,270 | 7/1974 | Paramonoff et al. | 277/15 |
| 3,871,665 | 3/1975 | Burke et al. | 277/24 |
| 4,173,138 | 11/1979 | Main | 72/349 |
| 4,976,131 | 12/1990 | Grims et al. | 72/347 |
| 5,171,023 | 12/1992 | Scott et al. | 277/24 |

*Primary Examiner*—Lowell A. Larson
*Assistant Examiner*—Rodney Butler
*Attorney, Agent, or Firm*—Mitchell D. Bittman; Jerome M. Berliner

[57] ABSTRACT

A bodymaker that transforms shallow metal cups into elongated can bodies includes a reciprocated ram which, during its forward stroke, drives the cups through a set of graduated circular dies. Ring shaped wipers engage the outer cylindrical surface of the ram and are arranged so that a first of the wipers scrapes tool coolant from the ram as the latter moves rearward and a second of the wipers scrapes hydraulic bearing fluid from the ram as the latter moves forward. The wipers are provided with flexible flaps that are in relatively low pressure frictional engagement with the ram resulting in only a very low temperature rise for the wipers to increase operating life thereof at production rates of approximately 400 per minute for cans of 2½ inch diameter.

18 Claims, 5 Drawing Sheets

37
51
36
52
59
56
58
57
35
23
24
60
25
61
152

88
88a
87a
86
91
88b
90
85
89

16
21
15
13
19
14
18
17
11
20
12

WIPING UNIT FOR RAM OF BODYMAKER

This is a continuation of application Ser. No. 08/295,232 filed on Aug. 23, 1994 now abandoned.

BACKGROUND OF THE INVENTION

This invention relates to can bodymakers in general and relates more particularly to an improved construction that minimizes mixing of hydrostatic liquid coolant that is supplied to tooling on the front end of a longitudinally reciprocating ram with bearing fluid that supports the ram.

U.S. Pat. No. 4,173,138, which issued Nov. 6, 1979 to R. M. Main and E. Paramanoff for a Can Bodymaker Having Improved Ram Support and Drive, describes metal working apparatus that transforms a relatively short cylindrical metal cup into a relatively tall cylindrical body for a two piece beverage container. Such bodymaker utilizes hydrostatic oil bearings to support and guide a horizontally reciprocated ram. While moving forward in its working stroke, the ram drives a cup through a stationary ring die set to reduce the thickness of the cup's cylindrical sidewall and increase the length thereof. Mounted at the front of the ram is a precision tool element that is inserted into the cup through its open rear end. To cool this tool element, liquid coolant is applied to the ram near the front end thereof.

Typically, the coolant is a soluble oil solution having approximately 2% to 4% soluble oil, and the remainder is water. Every effort must be made to limit the amount of soluble oil solution that works its way rearward and mixes with the hydrostatic bearing fluid of the drive system for the ram. That is, since the soluble oil solution contains between 96% and 98% water, mixing thereof with the oil-like hydrostatic bearing fluid will cause major wear and failure problems to the drive system. At the same time, every effort must be made to minimize the amount of hydraulic bearing fluid that moves forward and mixes with the soluble oil solution to interfere with its cooling function.

One prior art construction for minimizing comingling between the liquid coolant and the hydrostatic bearing fluid utilizes a ring sealing unit that includes cylindrical packing or stationary seals that are forced against the cylindrical surface of the ram by utilizing significantly high pressure. Because of this high pressure engagement at the interface between the stationary seals and the fast moving cylindrical surface of the ram, friction at the interface causes temperature of the seals to become so high that the seals wear rapidly and must be changed often. Further, subjecting the seals to high temperature has an adverse effect on tracking of the ram.

FIG. 10 herein illustrates a prior art ring sealing unit 11 that is co-axial with reciprocable ram 12 and surrounds sidewall 13 thereof. Sealing unit 11 consists of ring 14 and 0-spring 15. In cross-section, ring 14 is generally rectangular and its rear facing surface 16 is provided with depression 17 that is occupied by 0-spring 15. The latter is forced into depression 17 to spread rear corner portions of ring 14 into inner and outer annular lips 18, 19. Sealing unit 11 is fitted snugly within annular recess 21 of stationary machine frame 20, with the outer edge of lip 19 bearing against frame 20 and the inner edge of lip 18 bearing against outer cylindrical surface 13 of ram 12. The extensive area of engagement between lip 18 and surface 13 coupled with the relatively high pressure between them, results in high friction forces that generate high temperature when ram 12 reciprocates rapidly. The result is that seal unit 11 overheats and because of this deteriorates rapidly.

SUMMARY OF THE INVENTION

In order to overcome the foregoing problems of the prior art, the sealing units of the prior art are replaced by so-called ring wipers each of which includes an inclined relatively thin annular flap that is self biased to engage the outer surface of the ram at relatively low pressure. In fact, this pressure is so low that temperature rise at the interface between the annular flap and the ram is limited to a temperature where deterioration of the ring wiper resulting from that temperature rise is negligible. Further, at the interface between the flap and the ram, wear of the flap is so slow that effectiveness of the latter as an oil scraper lasts for an extended number of ram operations.

Accordingly, the primary object of the instant invention is to provide a can bodymaker with an improved construction insofar as functioning to reduce the amount of hydrostatic bearing fluid that moves into the tool region at the front end of the ram and also functions to reduce the amount of liquid coolant for tooling that moves to the hydrostatic bearings that support the ram during its reciprocating movement.

Another object is to provide a can bodymaker of this type wherein there is reduced frictional engagement force between the outer surface of the ram and elements which limit mixing of hydrostatic bearing fluid and liquid coolant.

Still another object is to provide a can bodymaker of this type in which ring wipers having thin annular flaps that engage the ram lightly are utilized for limiting mixing of the liquid coolant and the hydrostatic bearing fluid.

A further object is to provide a bodymaker that is constructed so that there is reduced operating temperature and reduced wear for elements of a wiping unit that functions to prevent mixing between the liquid coolant and the hydrostatic bearing fluid.

BRIEF DESCRIPTION OF THE DRAWINGS

In FIG. 2 the ram of the bodymaker is in its most rearward position after having completed its return stroke, in FIG. 3 the ram is in its most forward position after having completed its working stroke and in both FIGS. 2 and 3 the free or tool carrying end of the ram is at the right.

In FIG. 5 the tool carrying end of the ram is at the left.

In FIG. 6 the tool carrying end of the ram is at the left.

DETAILED DESCRIPTION OF THE INVENTION

Figure 1:
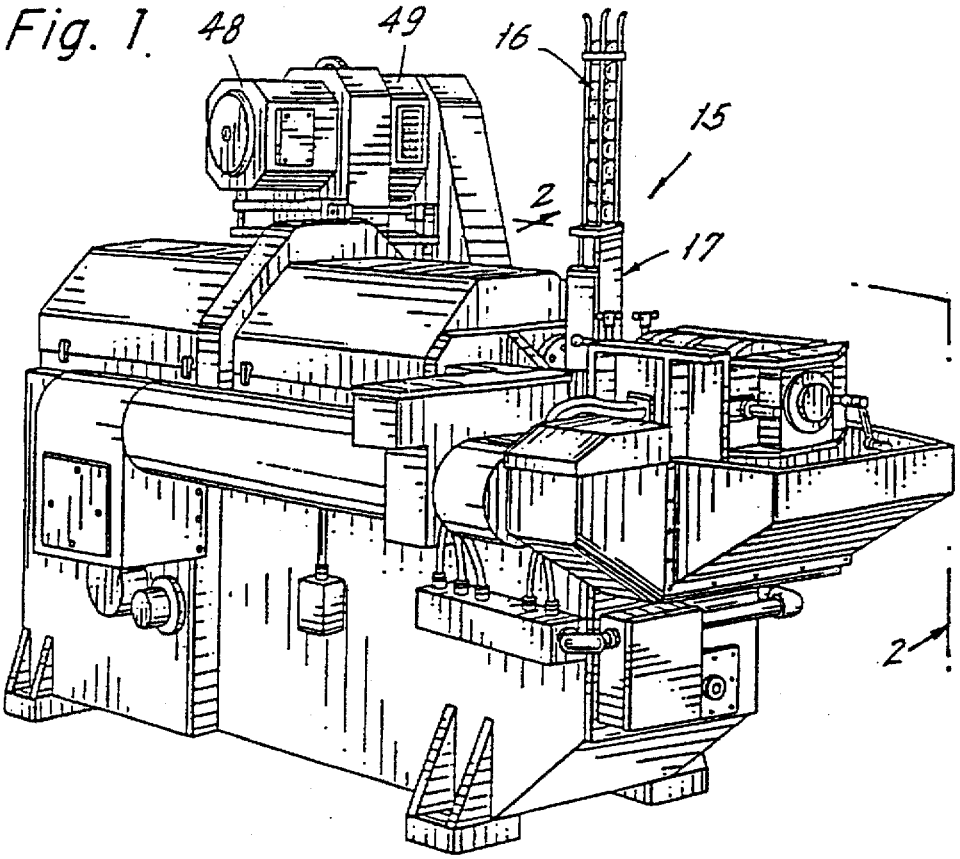
FIG. 1 is a perspective of a can bodymaker that is constructed in accordance with teachings of the instant invention to limit mixing of liquid tooling coolant with hydrostatic bearing fluid.
Figure 4:
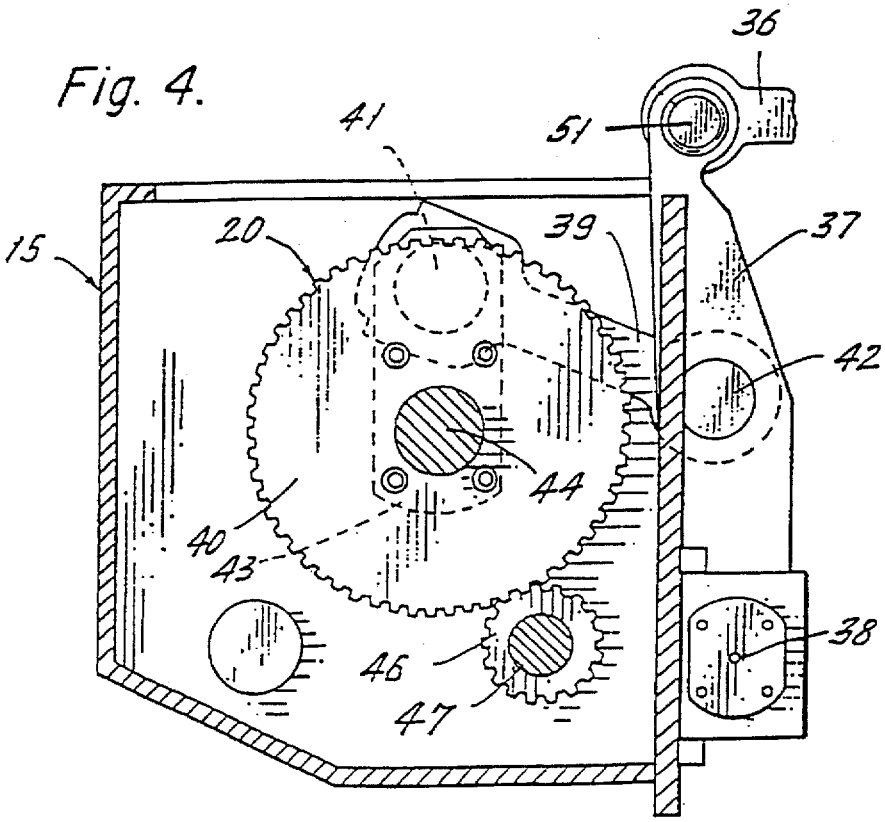
FIG. 4 is a fragmentary side elevation of the mechanism for reciprocating the ram.
Figure 2:
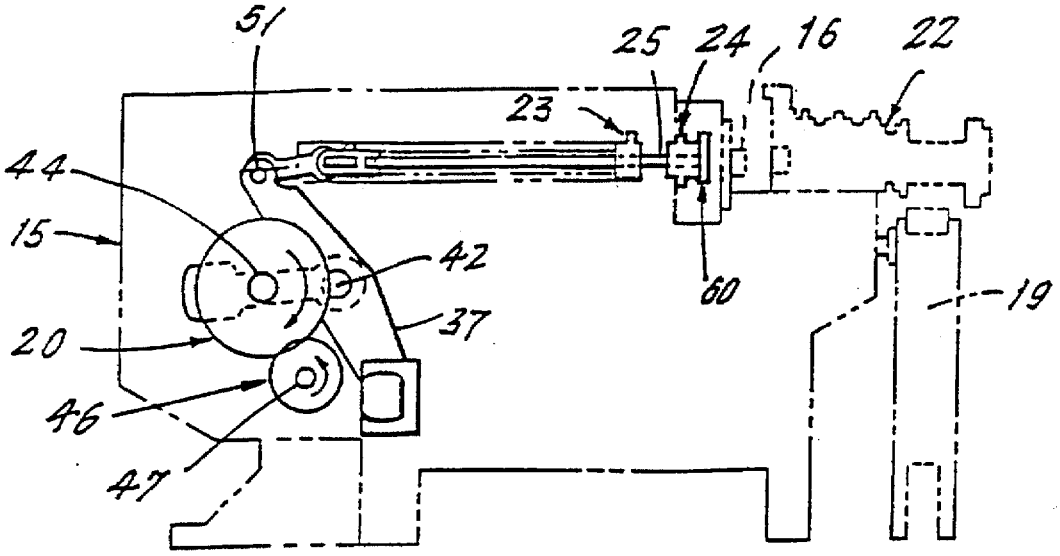
FIGS. 2 and 3 are schematics of the bodymaker of FIG. 1 looking in the direction of arrows 2—2 in FIG. 1.
Figure 3:
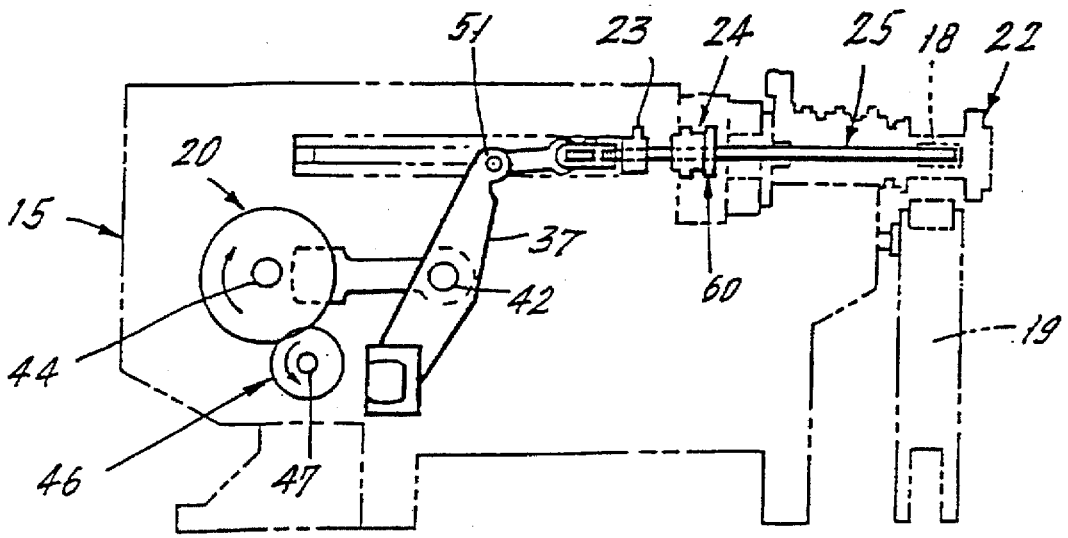

Reference is made to the Figures and more particularly to FIGS. 1 through 5 which, for the most part, are also found in the aforesaid U.S. Pat. No. 4,173,138, the teachings of which are incorporated herein by reference.

In a manner known to the art of making two piece metal beverage containers, bodymaker 15 transforms blanks in the form of shallow metal cups 16 (FIG. 2) delivered by infeed device 17 into elongated can bodies 18 (FIG. 3) which drop downward and are received by outfeed device 19. This is accomplished by utilizing reciprocating drive mechanism 20 to move horizontally disposed hollow ram 25 longitudinally forward in a working stroke from its rearmost position of FIG. 2 to its most forward position of FIG. 3, at which point movement of ram 25 is reversed and ram 25 moves in a return stroke to its most rearward position of FIG. 2. During its forward working stroke, tool element 61 at the front of ram 25 enters cup 16 through its open end and drives rear cup 16 through ring die assembly 22. This operation reduces the diameter and thickness of the sidewall for cup or blank 16 while elongating the sidewall to form can body 18. During its forward and rearward movement, ram 25 is supported by respective stationary spaced rear and front hydrostatic bearings 23 and 24. For reasons which shall be explained hereinafter, ram 25 also extends through wiping unit 60 that is disposed adjacent to the front of front bearing 24.

Figure 5:
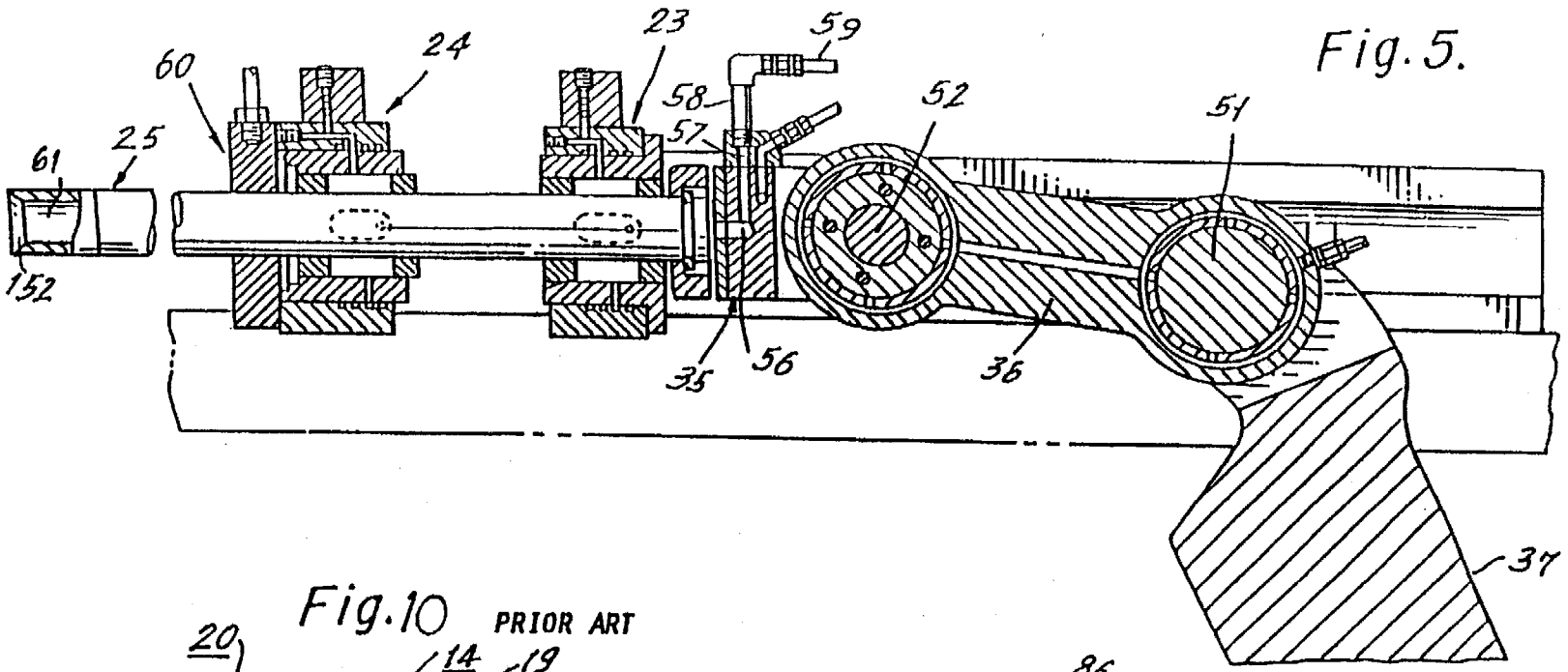
FIG. 5 is a fragmentary partially sectioned side elevation of the ram and its connection to the ram driving mechanism.

Driving mechanism 20 is connected to the rear of ram 25 by bearing slide assembly 35 (FIG. 5). The latter is pivotally connected at 52 to the front end of drive rod 36 whose rear end is pivotally connected at 51 to the free upper end of drive arm 37, and the lower end of drive arm 37 is fixed to the machine frame at pivot center 38 (FIG. 4), so as to oscillate thereabout. Arm 37 is driven by transfer arm 39, one end of which is connected by pivot 41 to crank arm 43 and the other end of which is pivotally connected at 42 to drive arm 37 at a point intermediate the ends thereof. Pivot 41 is at the free end of crank arm 43 which extends radially from main shaft 44 and is keyed thereto for rotation thereby. Bull gear 40 is also keyed to main shaft 44 for rotation therewith, and is in mesh with pinion 46 that is keyed to drive shaft 47 which is driven by electric drive motor 48 through variable speed drive 49.

To assure that can body 18 does not move rearward with ram 25, compressed air is applied to the interior of ram 25 through appropriate passageways of connecting means 35 at the rear of ram 25 and this compressed air exits through front opening 152 (FIG. 5) of tool element 61 to the inside of can body 18 to strip same from the front end of ram 25. For this purpose connecting means 35 is provided with a passage having connected axial 56 and transverse 57 sections, with the latter having short pipe 58 extending therefrom. Flexible hose 59 extending from pipe 58 is operatively connected to a can stripping control valve (not shown).

Figure 6:
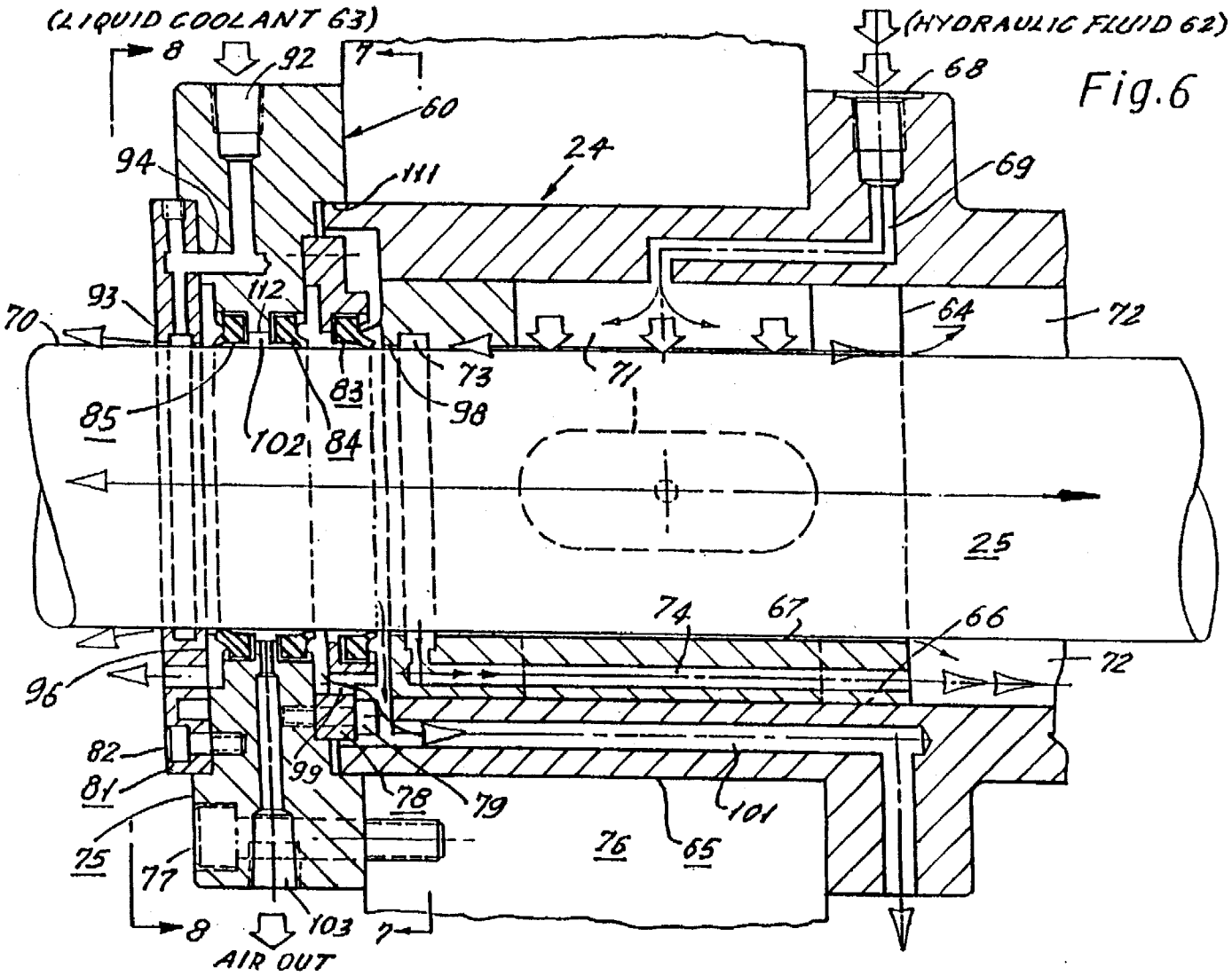
FIG. 6 is an enlarged vertical section of the front hydrostatic bearing and the ram wiping unit.
Figure 7:
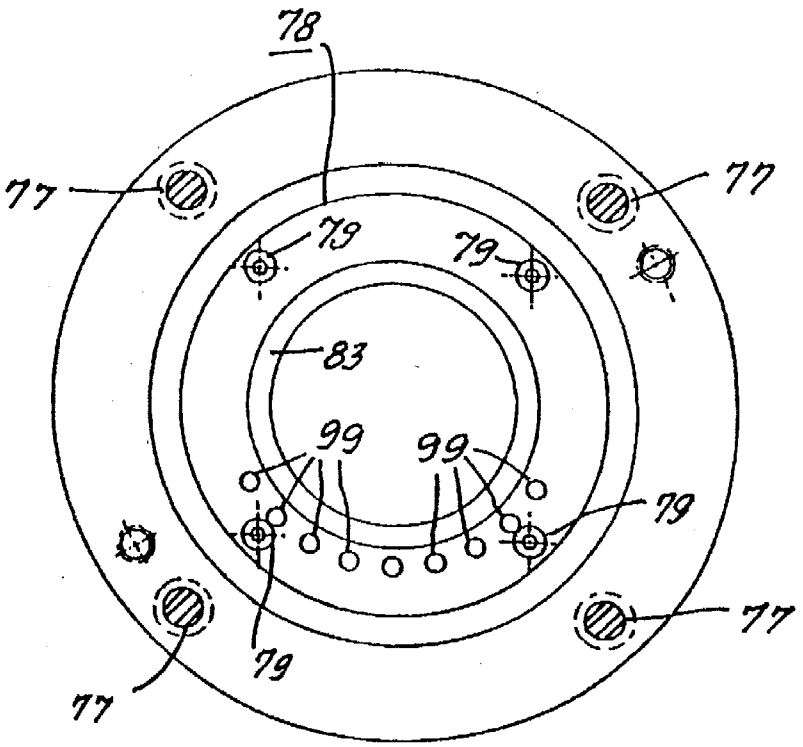
FIG. 7 is a rear elevation of the ram wiping unit looking in the direction of arrows 7—7 in FIG. 6.
Figure 8:
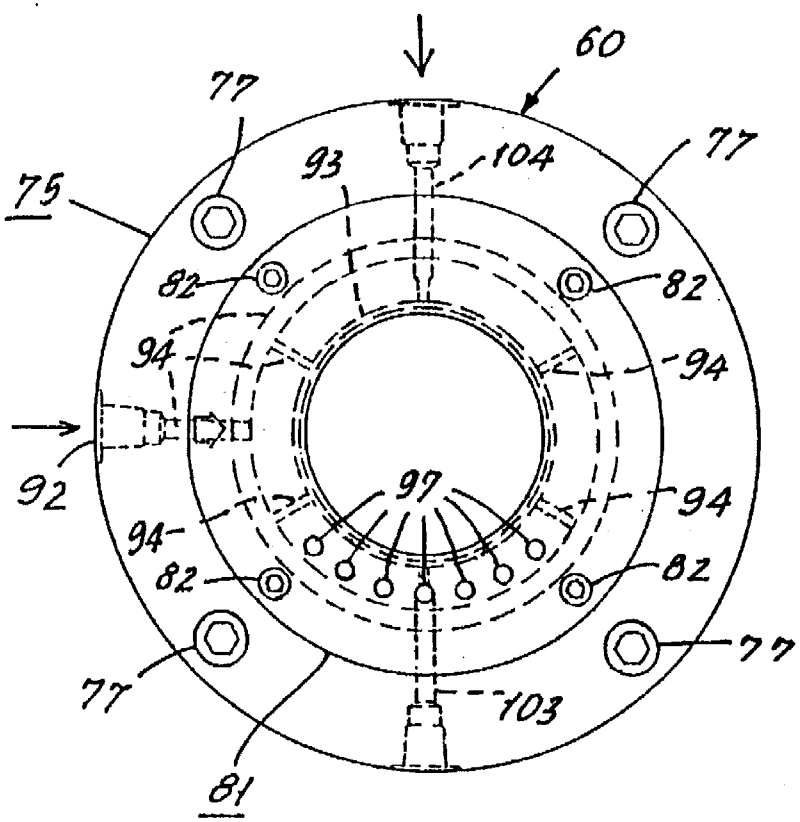
FIG. 8 is a front elevation of the ram wiping unit looking in the direction of arrows 8—8 in FIG. 6.

Wiping unit 60 of FIGS. 6–8 functions to prevent hydrostatic fluid 62 of the hydrostatic bearing units 23, 24 from moving forward of front unit 24 to the region of ram 25 where liquid coolant 63 is applied to ram 25 for cooling tool element 61. In addition, wiping unit 60 functions to prevent liquid coolant 63 from moving rearward and mixing with hydraulic fluid 62 in hydrostatic bearing unit 24.

More particularly, bearing unit 24 comprises inner cylinder 64 that is closely fitted within bore 66 of outer frame 65. Ram 25 extends axially through inner cylinder 64, with narrow gap 67 formed therebetween providing a path for hydraulic fluid 62 that is supplied at high pressure to bearing unit 24 through four inlets 68. Each of the latter is connected by an individual passage 69 in frame 65 to an individual pocket 71 that extends transversely through cylinder 64. There are four pockets 71 equally spaced around outside surface 70 of ram 25 and communicating with gap 67. Four axial passages 72 at the rear of bearing unit 24 provide a direct return for fluid 62 from the rear of gap 67 to a sump (not shown). Slightly to the rear of its front end, the inside of cylinder 64 is provided with circular groove 73 which is connected to passages 72 through individual fluid return lines 74 that extend axially inside the wall of cylinder 64.

Wiping unit 60, disposed immediately in front of bearing unit 24, includes main ring 75 secured to fixed frame portion 76 by four bolts 77. Rear ring 78 is secured to the back of main ring 75 by four bolts 79 and forward ring 81 is secured to the front of main ring 75 by four bolts 82. Main ring 75 supports wipers 84, 85 and rear ring 78 supports wiper 83 with wiper 84 being disposed between wipers 83 and 85. Circular interior surface 111 defines a shallow recess open at the rear of main ring 75 which receive the front of outer frame 65 and thereby axially aligns the central openings of bearing 24 and unit 60.

Figure 9:
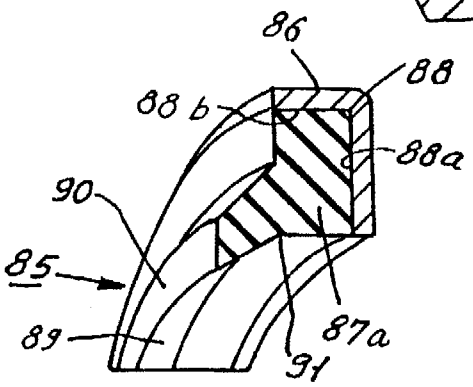
FIG. 9 is a fragmentary perspective of one of the ring wipers utilized to carry out the subject invention.

Each of the wipers 83–85 is generally of the same size and shape, that shape being seen by reference to FIGS. 6 and 9 which illustrate wiper 85 that comprises metal shell 86 and elastomer ring wiper 87 cemented to shell 86. Shell 86 is of L-shaped cross-section and is pressed into its operative position against annular shoulder 112 at the front face of main ring 75. Ring wiper **87*a* includes generally rectangular main section 87 and relatively thin flexible annular flap 89 that extends radially inward from corner 91 of main section 87 that is diagonally opposite intersection 88 between ring wiper surfaces 88*a*, 88*b* that abut shell 86. Flap 89 of wiper 85 is angled radially inward and forward from corner 91. The thickness of flap 89 tapers downward very gradually from its thick end or root at corner 91 to free edge 90. Flaps 89 of wipers 83 and 84** are each angled radially inward and rearward.

Liquid coolant 63 is supplied to inlet 92 of main ring 75, and flows through connected passage sections 94 in rings 75 and 81 to annular groove 93 in the interior surface of front ring 81. The radially inner side of groove 93 is open and faces ram surface 70 so that coolant 63 impinges on ram surface 70. Coolant 63 that flows forward along surface 70 to the front of ring 81 returns to another sump (not shown). Coolant 63 that flows rearward along surface 70 is sheared therefrom by the free edge 90 of wiper 85 and flows through annular space 96 and through a plurality of passages 97 in ring 81 to the front thereof, and to the later mentioned sump.

Hydraulic fluid 62 that flows along ram surface 70 and forward of sill 98 (FIG. 6) located at the rear end of the interior surfaces of cylinder 64, flows through a portion of labyrinth 99, including nine holes through rear ring 78, and axial passages 101 in outer frame 65 to the same sump that receives fluid 62 from passages 74. Sill 98 is relatively short in the direction parallel to the longitudinal axis of ram 25, and is closely spaced with respect to outer surface 70 of ram 25. This close spacing between sill 98 and surface 70 has the effect of causing most hydraulic fluid 62 that flows forward from pockets 71 to enter runoff groove 73.

Annular space 102 between back to back ring wipers 84, 85 is part of a runoff path that receives any stray hydraulic fluid 62 that might work its way to the front of ring wiper 84 and also receives any stray coolant 63 that might work its way behind ring wiper 85. Stray portions of hydraulic fluid 62 and/or liquid coolant 63 are removed as waste through outlet passage 103. This process is facilitated by pressurized air that is introduced through inlet passage 104. Both passages 103 and 104 extend radially from the outer edge of main ring 75 to space 102.

Figure 10:
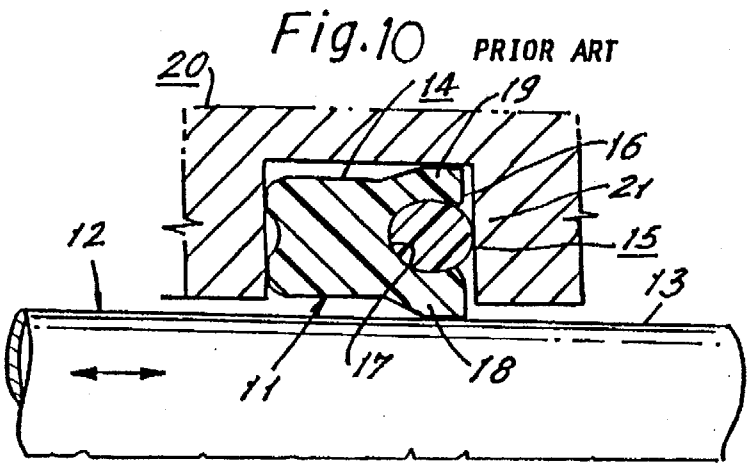
Fig. 10 PRIOR ART
FIG. 10 is a fragmentary vertical section of prior art sealing means that limits mixing between hydrostatic bearing fluid and liquid coolant for tooling carried by the ram.

Annular flap 89 is extremely flexible allowing free edge 90 to shear liquid from ram surface 70 as the latter moves toward that surface of flap 89 which intersects surfaces 70 at an obtuse angle. Flap 89 is self biased against ram surface 70, there being minimal pressure at the interface between flap 89 and surface 70, to reduce friction force, at the interface so that there is minimal heat rise. The result is extended life for ring wiper 87, and unstable tracking along the ram center-line axis is avoided. With a ram that is 2.50 inches in diameter, temperature at the ram/wiper interface has been limited to a 4° F. rise while operating the ram at 400 cycles/min. Desired improvements are obtained by limiting pressure at the interface between each free edge 90 and ram surface 70 to a point where friction forces between free edges 90 and ram surface 70 are reduced by approximately 85% compared to the prior art as exemplified by the construction illustrated in FIG. 10.

While two rearwardly inclined wiper units 83, 84 are provided for shearing hydraulic fluid 62 from surface 70 while ram 25 moves forward, it has been found that satisfactory operation can be obtained over an extended time period even if only one of the wiper units 83, 84 is utilized. The other wiper unit 85 shears liquid coolant 63 from surface 70 while ram 25 moves rearward.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A bodymaker for transforming metal cups into elongated can bodies, said bodymaker comprising:

an elongated ram having a front end and a cylindrical outer surface, and a tool on said ram at said front end;

a hydrostatic bearing surrounding said ram and including:

pressurized hydraulic fluid supporting said ram for horizontal longitudinal reciprocating movement, said hydraulic fluid being applied at high pressure to said cylindrical outer surface of said ram;

a groove disposed annularly and on a forward end of said bearing for relieving the high pressure of said hydraulic fluid at the forward end of said bearing; and a still disposed annularly, in close proximity to said cylindrical outer surface, and in front of said groove, for limiting a thickness of hydraulic fluid left on said cylindrical outer surface after said hydraulic fluid passes through said groove and said sill;

drive means operatively engaged with said ram to impart said reciprocating movement to said ram to move said ram forward in a working stroke followed by rearward movement of said ram in a return stroke;

a die set forward of said bearing for transforming said cups into said can bodies as said cups are driven one by one through said die set by said tool as said ram operates through said working stroke;

a liquid coolant which impinges upon said outer surface at a location on said ram disposed in front of said bearing;

first and second ring wipers having aligned respective first and second apertures through which said ram extends;

said first and second ring wipers being self-biased into engagement with the cylindrical outer surface, and including respective flexible annular first and second flaps that define the respective first and second apertures;

said first and second flaps having respective radially inward first and second free edges that are biased radially inward into low pressure engagement with said outer surface;

said first flap being forward of said second flap and both of said flaps being in front of said bearing;

said first flap being inclined rearward and radially outward from said first free edge to shear liquid coolant that is forward of said first flap from said outer surface is a forward direction as said ram moves rearward;

said second flap being inclined forward and radially outward from said second free edge to shear hydraulic fluid that is rearward of said second flap from said outer surface in a rearward direction as said ram moves forward.

2. A bodymaker as defined in claim 1 also including:

a runoff path positioned between said first and second flaps to receive and divert away from said second ring wiper any of said liquid coolant that might move rearward of said first flap;

said runoff path also being positioned to receive and divert away from said first ring wiper any of said hydraulic fluid that might move forward of said second flap.

3. A bodymaker as defined in claim 1 in which engagement of said first and second flaps with said cylindrical outer surface are at sufficiently low pressures to limit temperature of said cylindrical outer surface where same is engaged by said first and second flaps to a 4° F. rise when said ram has an outer diameter of approximately 2.50 inches and is operating with a working stroke of approximately 24 inches to produce can bodies at a rate of approximately 400 per minute.

4. A bodymaker as defined in claim 1 in which said first and second ring wipers also include respective first and second ring bodies each having a generally rectangular cross-section;

said first flap extending radially inward from a corner of said first body and said second flap extending radially inward from a corner of said second body.

5. A bodymaker as defined in claim 1 in which said first and second ring wipers are components of respective first and second wiper units that include respective first and second ring bodies;

said first and second wiper units also including respective first and second ring frames each having a generally L-shaped cross-section;

said first and second ring bodies being cemented to the respective first and second frames;

a mounting ring having a central opening through which said ram extends;

said mounting ring having front and rear faces, and also having first and second interior surfaces that are circular, said first interior surface being at said front face and said second interior surface being at said rear face;

said first and second ring frames being frictionally engaged with the respective first and second interior surfaces to mount said wiper units to said mounting ring.

6. A bodymaker as defined in claim 1 in which said first and second ring wipers also include respective first and second ring bodies;

said first flap extending radially inward from said first ring body and said second flap extending radially inward from said second ring body;

said first and second flaps being formed integrally with the respective first and second ring bodies; and said first and second ring wipers being self-biased into engagement with said cylindrical outer surface.

7. A bodymaker as defined in claim 1 also including a third ring wiper having a construction essentially the same as that of said second ring wiper;

said third ring wiper including a flexible annular third flap having a radially inward third free edge in low pressure engagement with said outer surface of said ram;

said third flap being inclined forward and radially outward from said third free edge to shear hydraulic fluid that is rearward of said third flap from said outer surface as said ram moves forward.

8. A bodymaker as defined in claim 1 in which said hydrostatic bearing includes a plurality of pockets arranged in an array surrounding and confronting said cylindrical outer surface with said pressurized hydraulic fluid exiting said pockets to impinge upon said cylindrical outer surface and thereby support said ram.

9. A bodymaker as defined in claim 1 in which said first and second flaps each have a thickness which gradually tapers down from their radially outward roots toward their said first and second free edges; said first and second free edges being defined by intersecting surfaces of said flap which forms acute angles at said first and second free edges.

10. The bodymaker of claim 1, wherein the first and second flaps are biased radially inward without the use of high pressure fluids, and no high pressure fluids impinge upon the first and second flaps.

11. The bodymaker of claim 1, wherein no high-pressure seals are disposed between the hydrostatic bearing and the liquid coolant.

12. A bodymaker as defined in claim 3 in which said first and second flaps each have a thickness which gradually tapers down from their radially outward roots toward their said first and second free edges; said first and second free edges being defined by intersecting surfaces of said flap which forms acute angles at said first and second free edges.

13. A bodymaker as defined in claim 6 in which each of said first and second ring bodies has a generally rectangular cross-section; and said first flap extending radially inward from a corner of said first body and said second flap extending radially inward form a corner of said second body.

14. A bodymaker as defined in claim 6 in which pressure between each of said first and second flaps and said cylindrical outer surface is limited to a point where temperature of said outer surface where same is engaged by said flaps is limited to a rise in temperature of approximately 4° F.

15. A bodymaker as defined in claim 13 in which said first and second ring wipers are components of respective first and second wiper units;

said first and second wiper units also including respective first and second ring frames each having a generally L-shaped cross-section;

said first and second bodies being cemented to the respective first and second frames;

a mounting ring having a central opening through which said ram extends;

said mounting ring having front and rear faces, and also having first and second interior surfaces that are circular, said first interior surface being at said front face and said second interior surface being at said rear face;

said first and second ring frames being frictionally engaged with the respective first and second interior surfaces to mount said wiper units to said mounting ring.

16. A bodymaker as defined in claim 7 in which said first and second flaps each have a thickness which gradually tapers down from their radially outward roots toward their said first and second free edges; said first and second free edges being defined by intersecting surfaces of said flap which forms acute angles at said first and second free edges.

17. A bodymaker as defined in claim 9 in which said first and second ring wipers also include respective first and second ring bodies;

said first flap extending radially inward from said first ring body and said second flap extending radially inward from said second ring body;

said first and second flaps being formed integrally with the respective first and second ring bodies;

each of said first and second ring bodies having a generally rectangular cross-section, said first flap extending radially inward from a corner of said first body and said second flap extending radially inward from a corner of said second body;

said first and second ring wipers being components of respective first and second wiper units which also include respective first and second ring frames each having a generally L-shaped cross-section, with said first and second bodies being secured to the respective first and second ring frames;

said first ring frame and said first flap being at diagonally opposite corners of said first ring body, and said second ring frame and said second flap being at diagonally opposite corners of said second ring body.

18. A bodymaker as defined in claim 17 also including a mounting ring having a central opening through which said ram extends;

said mounting ring having front and rear faces, and also having first and second interior surfaces that are circular, said first interior surface being at said front face and said second interior surface being at said rear face;

said first and second ring frames being frictionally engaged with the respective first and second interior surfaces to mount said wiper units to said mounting ring.

* * * * *